US006502267B2

(12) United States Patent
MacDonald et al.

(10) Patent No.: US 6,502,267 B2
(45) Date of Patent: Jan. 7, 2003

(54) CONVEYOR CROSSOVER

(75) Inventors: Ellie H. MacDonald, Timmonsville, SC (US); David A. Perry, Florence, SC (US)

(73) Assignee: Aluminum Ladder Company, Florence, SC (US)

( * ) Notice: Subject to any disclaimer, the term of this patent is extended or adjusted under 35 U.S.C. 154(b) by 55 days.

(21) Appl. No.: 09/858,966

(22) Filed: May 16, 2001

(65) Prior Publication Data

US 2002/0174496 A1 Nov. 28, 2002

(51) Int. Cl.[7] ..... E01D 1/00; E01D 15/08
(52) U.S. Cl. ..... 14/69.5; 14/71.7
(58) Field of Search ..... 14/71.5, 69.5, 14/71.1, 71.7, 32, 33

(56) References Cited

U.S. PATENT DOCUMENTS 427,378 A * 5/1890 Thomson ..... 114/362
3,747,354 A * 7/1973 Macomber ..... 14/69.5
4,296,516 A * 10/1981 Jarnum ..... 14/42
4,473,916 A * 10/1984 Connold ..... 14/42
4,679,657 A * 7/1987 Bennett et al. ..... 182/1
4,718,812 A * 1/1988 Smalley et al. ..... 14/69.5
5,671,823 A * 9/1997 Oakes ..... 182/113
5,862,884 A * 1/1999 Smith ..... 14/69.5
5,944,169 A * 8/1999 Allen ..... 186/59

FOREIGN PATENT DOCUMENTS

FR 2624532 A1 * 6/1989 ..... E01D/15/06

* cited by examiner

*Primary Examiner*—Robert E. Pezzuto
*Assistant Examiner*—Raymond W Addie
(74) *Attorney, Agent, or Firm*—Charles L. Schwab; Nexsen Pruet Jacobs & Pollard, LLC

(57) ABSTRACT

A conveyor crossover has a pivotable ramp which is moved from a horizontal bridging position across a conveyor to an upright position is which it is out of the way of material being moved by the conveyor. The ramp is raised and lowered by a control system which includes a pair of fluid actuators controlling pivotal movement of the ramp together with controls at both sides of the conveyor for adjusting a control valve controlling flow of fluid to and from the actuators. A latch mechanism is provided to hold the ramp in its raised position.

11 Claims, 3 Drawing Sheets

CONVEYOR CROSSOVER

TECHNICAL FIELD

This invention relates to a conveyor crossover having a pivotable ramp which can be moved from a raised position to a lowered position in which personnel can pass over a conveyor. Deployment of the conveyor crossover can be controlled from either side of the conveyor

BACKGROUND OF THE INVENTION

Horizontally disposed conveyors are commonly used in manufacturing, storage and processing facilities to move material, components and/or products to or from a facility or from place to place within a facility. In some facilities it is necessary for personnel to move from one lateral side of a conveyor to the other lateral side. Since the conveyors usually are relatively long it takes an excessive amount of time to walk around the conveyor. The conveyor could be stopped and the personnel walk or crawl over the conveyor; however, this solution is far too hazardous. Elevated walkways may be used in some facilities to permit personnel to pass over a conveyor carrying material or products, however, such walkways are relatively expensive and some facilities do not have sufficient clearance above the conveyor for suitable overhead walkways.

BRIEF SUMMARY OF THE INVENTION

This invention provides a crossover structure which includes a pivoted ramp which can be temporarily lowered from a raised position to a substantially horizontal lowered position in which it bridges a conveyor, thereby permitting personnel to pass safely over the conveyor. In its raised position the conveyor is removed from the path of material normally moved by the conveyor. The ramp is pivoted by fluid power actuators controlled by a control valve having raise positions of adjustment. A latch automatically locks the ramp in its raised position of adjustment and a fluid actuator disengages the latch automatically when the control valve is moved to its lower position of adjustment. The controls for the conveyor crossover include an emergency stop (E-stop) feature.

BRIEF DESCRIPTION OF THE DRAWINGS

One embodiment of the invention is illustrated in the accompanying drawings, in which.

DETAILED DESCRIPTION OF THE INVENTION

Figure 1:
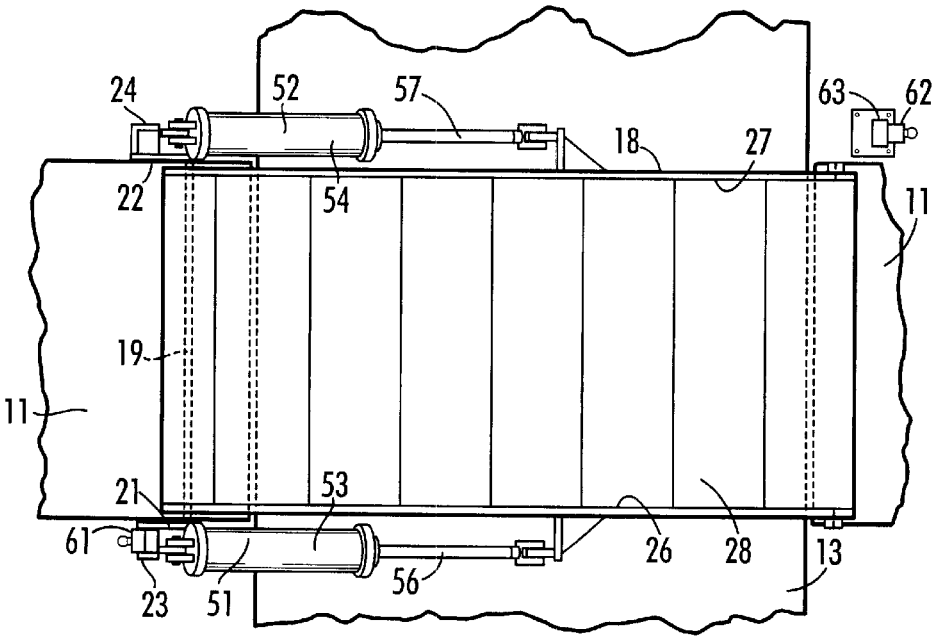
FIG. 1 is a top view of the conveyor crossover with its ramp in a lowered position and with its handrails removed for illustration purposes.
Figure 2:
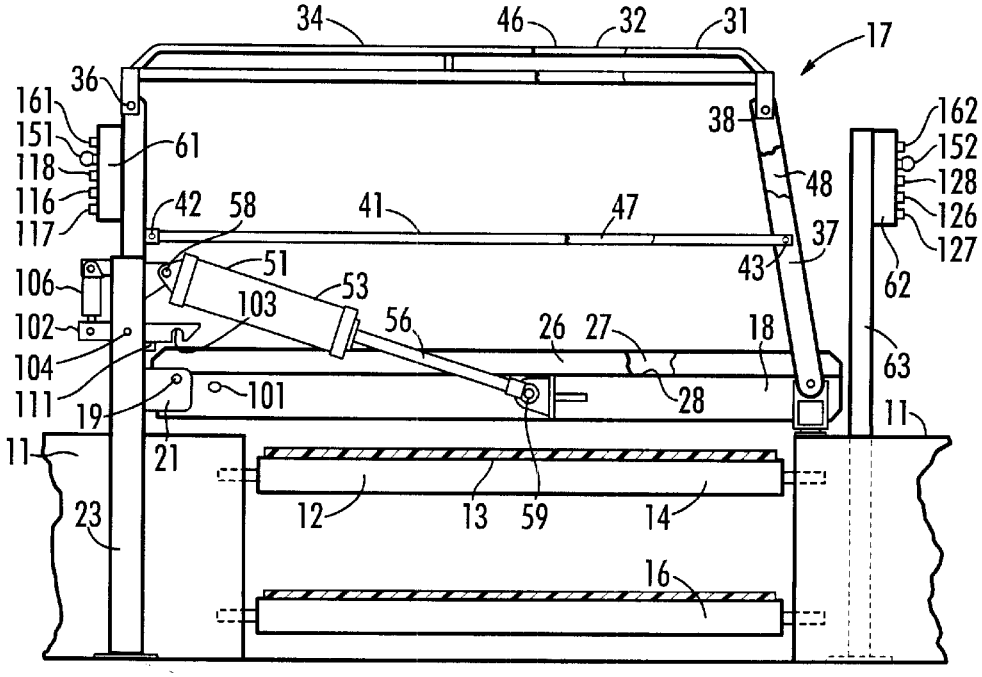
FIG. 2 is a side view of the conveyor crossover shown in FIG. 1 and showing handrails.

Referring to FIGS. 1 and 2, a personnel walkway 11 intersects a horizontally extending belt conveyor 12 which includes an endless belt 13 supported on suitable support rollers 14 and 16. A conveyor crossover 17 is provided to permit personnel to safely cross over the conveyor 12. The conveyor crossover 17 includes a flat ramp 18 which is pivotally connected by a pin 19 to brackets 21 and 22 welded to a pair of upright supports 23 and 24, respectively, for pivotal movement about a horizontal transverse axis between a substantially horizontal position, shown in FIG. 2, to an upright raised position, shown in FIG. 3. The ramp 18 includes a pair of the toe boards 26 and 27 which prevent the feet of personnel walking over the ramp 18 from slipping over the side of the ramp 18. The toe boards 26 and 27, which extend above the level of the floor 28 of the ramp 18, also help to prevent loose items from falling or sliding over the side of the ramp 18 onto the conveyor 12.

Figure 3:
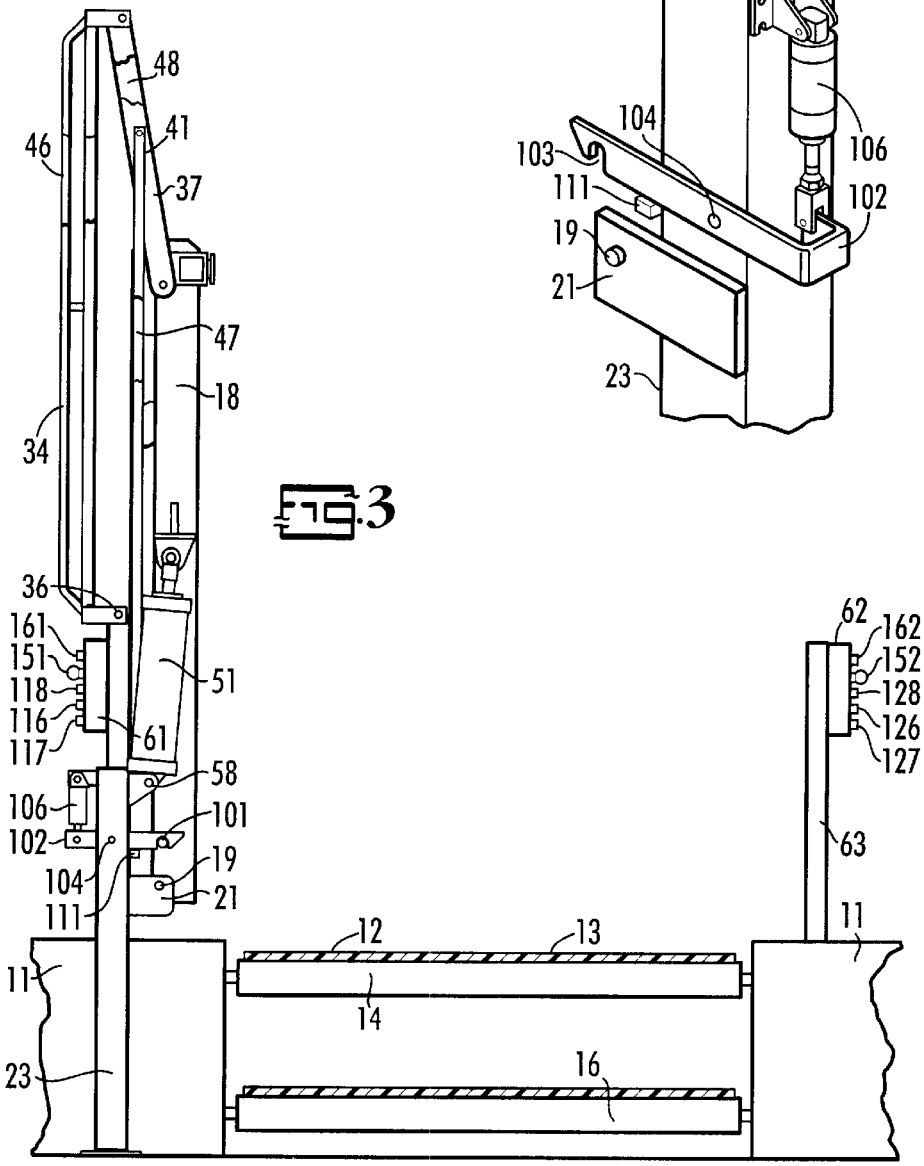
FIG. 3 is a side view of the conveyor crossover with the ramp in its raised position.

A suitable pair of handrail structures 31 and 32 are provided at laterally opposite sides of the ramp. As shown in FIGS. 1 and 3, the handrail structure 31 includes an upper handrail 34 pivotally connected at one end to the upper end of the support 23 on a horizontal transverse axis 36 and pivotally connected at its opposite end to the upper end of an upright support member 37 on a horizontal transverse axis 38. The lower end of the support member 37 is pivotally connected to the free end of the ramp 18. The handrail structure 31 also includes a lower handrail 41 pivotally connected at its opposite ends to the support 23 and the support member 37 on a horizontal transverse axes 42 and 43, respectively. In a similar manner an upper handrail 46 and a lower handrail 47 of the handrail structure 32 are pivotally connected to the support 24 and a support member 48 on the horizontal transverse axes 36, 38, 42 and 43. For illustration purposes the handrails 31 and 32 are not shown in FIG. 1.

The ramp 18 is pivoted from its horizontal lowered position shown in FIG. 2 to its upright raised position shown in FIG. 3 by a control system which includes a pair of fluid actuators 51 and 52. The fluid actuators 51 and 52 include cylinders 53 and 54 and pistons with piston rods 56 and 57 extending from the rod end of the cylinders 53 and 54 respectively. The closed ends of the cylinders 53 and 54 are pivotally connected to the supports 23 and 24 on a horizontal transverse axis 58 disposed above the pivot pin 19 and the piston rods 56 and 57 are pivotally connected to laterally opposite sides of the ramp 18 on a horizontal transverse axis 59.

The fluid control system provided for raising and lowering the ramp 18 includes a first manually operated control 61 mounted on the support 23 at one side of the conveyor 12 and a second manually operated control 62 mounted on a post 63 at the opposite side of the conveyor 12. Either control 61 or control 62 can be manually operated to raise, lower or stop movement of the ramp 18. When the fluid actuators 51 and 52 are contracted, the ramp 18 is pivoted from its substantially horizontal position shown in FIGS. 1 and 2 to a raised position shown in FIG. 3 in which it is out of the way of any items being conveyed by the conveyor 12.

Figure 4:
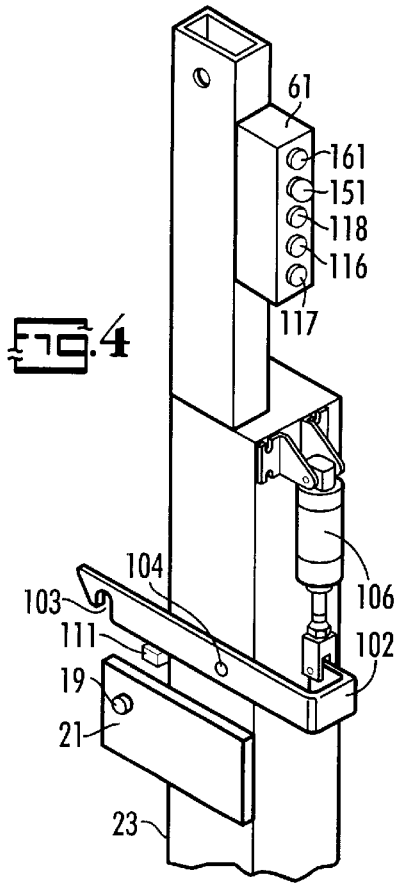
FIG. 4 is a perspective view of a latch mechanism.
Figure 5:
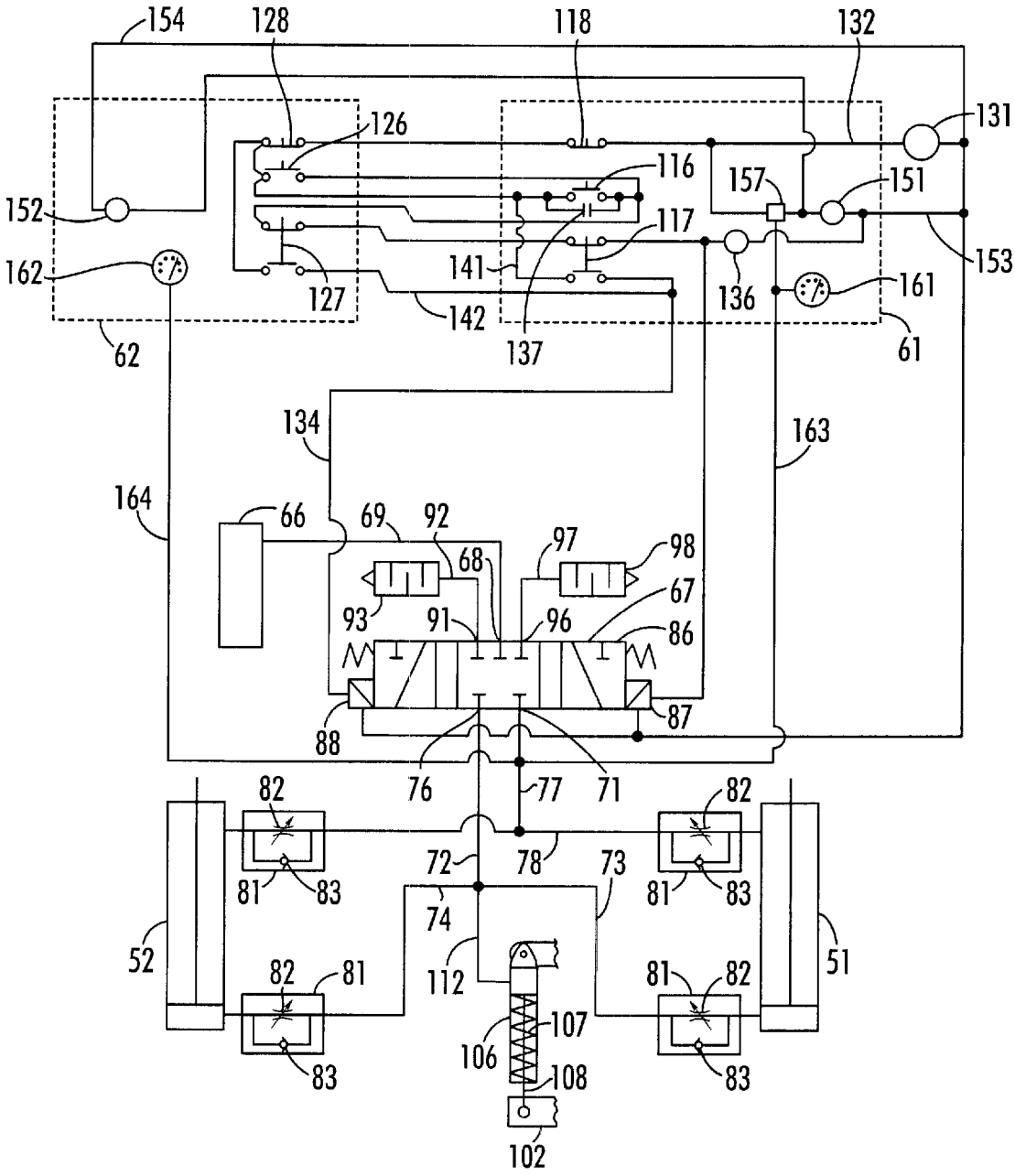
FIG. 5 is a schematic of the fluid power control for operating the conveyor crossover.

Referring also to FIGS. 4 and 5, the fluid actuators 51 and 52 are supplied pressurized air from a source of fluid pressure in the form of a pressurized air tank 66 by way of a solenoid control valve 67 whose inlet port 68 is connected to the tank by a fluid line 69. The control valve includes a raise port 71 connected to the rod end of the actuators 51 and 52 by way of a fluid line 72 and branch lines 73 and 74. The control valve also includes a lower port 76 connected to the closed end of the actuators 51 and 52 by a fluid line 77 and branch lines 78 and 79. A flow regulator 81 is installed in each of the branch lines 73, 74, 78 and 79. Each flow regulator 81 has a pair of parallel flow paths with a flow restrictor 82 in one flow path and a one way check valve 83 in the other flow path. The restrictor 82 and check valve 83 function to allow unrestricted flow to the actuators 51 and 52 but restricted flow from the actuators 51 and 52. Thus the restrictors 82 govern the speed of extension and contraction of the linear fluid actuators 51 and 52. The control valve 67 includes a reciprocable flow control element or spool 86 which is spring biased to the illustrated hold or emergency stop position.

The control valve 67 is an electrically controlled solenoid control valve which includes a raise coil 87 and a lower coil 88. When the raise coil 87 is energized, the flow control element 86 is moved to the left, as viewed in FIG. 5, thereby connecting the inlet port 68 with the raise port 71 and connecting lower port 76 with an exhaust port 91 by which air is exhausted to the atmosphere by way of a fluid line 92 and a muffler 93. When the lower coil 88 is energized, the flow control element 86 is moved to the right, as viewed in FIG. 5, thereby connecting the inlet port 68 with the lower port 76 and connecting the raise port 71 with an exhaust port 96 by which air from the rod end of the actuators 51 and 52 is exhausted to the atmosphere by way of a fluid line 97 and a muffler 98.

When the ramp 18 is raised, by movement of the flow control element 86 to the left, as shown in FIG. 5, the actuators 51 and 52 contract and the ramp 18 is pivoted about the horizontal transverse axis of pivot pin 19 to an upright position shown in FIG. 3. As the ramp 18 approaches its upright position, a lug 101 on the side of the ramp 18 cams against a tapered free end of a latch lever 102 and the lug 101 lockingly engages with a notch 103 formed in the lever 102, thereby locking the ramp 18 in its upright raised position. In this raised position of the ramp 18, the axis 58 lies on the conveyor side of a plane through the axis of pin 19 and the axis 36.

The latch lever 102, which is pivotally connected at a midpoint to the support 23 on a horizontal transverse axis 104, is pivotally controlled by a reciprocable actuator 106 having a rod end pivotally connected to the end of the latch lever 102 remote from the end in which the notch 103 is formed and its closed end pivotally connected to the support 23. As shown in FIG. 5, an internal coil spring 107, surrounding the rod 108 of the fluid actuator 106, resiliently biases the lever 102 to its illustrated latching position. An abutment 111 on the support 23 is engaged by the lever 102 to prevent the lever 102 from being pivoted beyond the latching position shown in FIGS. 2, 3 and 4. The latch lever 102, the lug 101 and the spring biased fluid actuator 106 form a releasable latch which automatically locks the ramp 18 in its upright position, when it is moved to that position. As shown in FIG. 5, the closed end of the latch actuator 106 is connected to the lower port 76 by way of a fluid line 112 and the fluid line 72. This connection provides an automatic release of the latch when the flow control element 86 is moved to its lower position of adjustment.

The hereinbefore mentioned fluid control system for raising and lowering the ramp 18 includes a first and second controls 61 and 62 at opposite lateral sides of the conveyor 12. Control 61 includes raise, lower and emergency stop push button switches 116, 117 and 118, and control 62 includes raise, lower and emergency stop switches 126, 127 and 128. The emergency stop switches 118 and 128 are normally in their illustrated closed position of adjustment and the raise and lower switches 116, 126, 117 and 127 are normally in their illustrated open position of adjustment. As illustrated in the drawings, these switches may be manually operated push button switches in consoles mounted on support 23 and post 63. The switches may be biased to or detented in their illustrated positions.

Electric current is supplied to the controls 61 and 62 by a source of electric power 131 by way of a lead 132, and electric current is supplied by the controls 61 and 62 to the coils 87 and 88 by output leads 133 and 134. If either raise switch 116 or 126 is closed, coil 87 of the solenoid valve 67 is energized and the flow control element 86 moves to the left to its raise position of adjustment. When the raise coil 87 is energized, a relay 136 connected in parallel with the coil 87 closes contacts 137 which are in bridging relation to the contacts of switch 116 thereby providing a holding circuit to maintain the control valve 67 in its raise position of adjustment even though the raise push button switches 116 and 126 are released or moved to their open positions. Thus the rod ends of the actuators are maintained in a pressurized condition whenever the ramp is raised to its upright position. This aspect of the control system and the latch mechanism provide redundant safety features for the conveyor crossover. It should be understood that if either one of the emergency stop switches 118 or 128 is actuated to its open position, pivotal movement of the ramp 18 is halted and the ramp does not move from the halted position until a raise or a lower switch is actuated.

The lower switches 117 and 127 have two sets of contacts, the upper set of contacts being in the lead 133 to the raise coil 87 and the lower set of contacts being in branch leads 141 and 142 lead 134 to lower coil 88. When either of the lower switches 117 or 127 closes its contacts, the circuit to the raise coil 87 via lead 133 is broken and the holding relay 136 is deenergized and the lower coil 88 is energized causing the flow control element 86 to move to the right to its lower position of adjustment in which pressurized air is supplied to the closed end of the actuators 51 and 52 and to the closed end of the actuator 106. Extension of the actuator 106 pivots the latch lever 102, which raises the notch 103 from engagement with the lug 101 thereby disengaging the latch mechanism.

For additional safety, the control consoles may be provided with visible indicators signaling pressurization of the raise line 77. Signal lights 151 and 152 in circuits 153 and 154 are lit when the line 77 connected to the raise port 71 of the control valve 67 is sufficiently pressurized to close the pressure actuated switch 157 in circuits 153, 154. Redundant visible indicators are provided in the form of pressure gauges 161 and 162 connected to the fluid lines 163 and 164 between line 77 and the pressure switch 157.

This conveyor crossover not only has a latch mechanism in the form of a spring biased and notched lever 102 and a lug 101 for holding the ramp 18 in a raised position, but also has a control system which automatically maintains pressure on the actuators 51 and 52 to insure that the ramp stays in its raised position until the controls are operated to lower the ramp. A signal light and a pressure gauge are provided on each side of the conveyor to provide visual indication of adequate air pressure on the raise side of the actuators 51, 52 to safely lower the ramp 18, thus avoiding a free fall of the ramp 18.

What is claimed is:

1. A conveyor crossover for a personnel walkway over a conveyor which is operable to move material in a horizontal direction, comprising:

a pair of upright supports adjacent one lateral side of said conveyor, one of said supports being disposed at one side of said walkway and the other of said supports being disposed at the other side of said walkway;

a flat ramp having one end pivotally connected to said supports on a first horizontal axis transverse to said walkway for pivotal movement between a substantially horizontal position in which said ramp bridges said conveyor and an upright position in which said ramp is out of the path of said material being moved via said conveyor, said ramp having laterally opposite sides;

first and second extensible and contractible fluid actuators having first corresponding ends pivotally connected, respectively to said supports on a second horizontal axis parallel to and above said first horizontal axis and having second corresponding ends pivotally connected respectively to said laterally opposite sides of said ramp on a third horizontal axis parallel to said first and second horizontal axis, said ramp being in said substantially horizontal position when said first and second fluid actuators are extended and said ramp being in said upright position when said fluid actuators are contracted and a fluid control system including a source of pressure fluid, a control valve connected in pressure fluid receiving relation to said source of pressure fluid and connected in controlling relation to said first and second fluid actuators, said control valve including a flow control element having raise, lower and emergency stop positions of adjustment and first and second manually operated controls positioned on opposite sides, respectively, of said conveyor, each said controls being operable to move said flow control element to said positions of adjustment.

2. The conveyor crossover as set forth in claim 1 wherein said control valve is electrically operated and each of said controls includes manually operated raise, lower and emergency stop switches operable to cause said flow control element to move to said raise, lower and emergency stop positions of adjustment, respectively.

3. The conveyor crossover as set forth in claim 1 having a releasable latch movable between a latch position and a release position, said latch automatically locking said ramp in said upright position when said ramp is pivoted to said upright position and said latch being automatically released when either one of said manually operated remote controls is operated to cause said flow control element to be adjusted to its lower position of adjustment.

4. The conveyor crossover as set forth in claim 3 having a latch release mechanism including a third fluid actuator connected in fluid receiving relation to said control valve, said third actuator receiving pressure fluid when said flow control element is moved to its lower position of adjustment and said third fluid actuator releasing said latch upon receipt of pressure fluid.

5. The crossover conveyor as set forth in claim 4 wherein said latch is biased to its latch position by a spring.

6. The crossover conveyor as set forth in claim 5 wherein said third fluid actuator includes cylinder and piston components, said piston including a piston rod extending from one end of said cylinder and wherein said spring is a coil spring inside said cylinder in encompassing relation to said piston rod.

7. The conveyor crossover as set forth in claim 1 wherein each of said fluid actuators has a cylinder with a closed end, a rod end and a piston with a rod extending from said rod end of said cylinder, said closed ends of said pistons being pivotally connected to said supports, respectively and said rods being connected, respectively, to said laterally opposite sides of said ramp, and further comprising a visible indicator adjacent each of said controls providing indication of the pressurization of said rod end of said cylinders.

8. The conveyor crossover as set forth in claim 7 wherein said visible indicator is a pressure gauge.

9. The conveyor crossover as set forth in claim 7 wherein said visible indicator is an electric light.

10. The conveyor crossover as set forth in claim 1 including a source of electric power and wherein said valve is a solenoid valve, wherein said manually operated controls each include raise, lower and emergency stop electric switches interconnected between said source of electric power and said solenoid valve.

11. The conveyor crossover of claim 10 including a holding relay maintaining said flow control element of said solenoid valve in its raise position of adjustment when moved to that position until one of said lower switches are actuated to lower said ramp.

* * * * *